US005099169A

United States Patent [19]

Vriens

[11] Patent Number: 5,099,169

[45] Date of Patent: Mar. 24, 1992

[54] SHADOW MASK COLOR DISPLAY TUBE

[75] Inventor: Leendert Vriens, Eindhoven, Netherlands

[73] Assignee: U.S. Philips Corporation, New York, N.Y.

[21] Appl. No.: 505,868

[22] Filed: Apr. 6, 1990

[30] Foreign Application Priority Data

Mar. 8, 1990 [NL] Netherlands ..... 9000530

[51] Int. Cl.[5] ..... H01J 29/07

[52] U.S. Cl. ..... 313/403; 313/402; 313/440

[58] Field of Search ..... 313/403, 402, 440, 412, 313/413, 407, 408, 415; 335/209-211

[56] References Cited

U.S. PATENT DOCUMENTS 3,686,525 8/1972 Naruse et al. ..... 313/402
3,800,176 3/1974 Gross et al. ..... 313/403
3,914,641 10/1975 Standaart ..... 313/411
4,433,268 2/1984 Arisato ..... 313/440
4,636,683 1/1987 Tokita et al. ..... 313/403

*Primary Examiner*—Michael Razavi
*Attorney, Agent, or Firm*—Robert J. Kraus

[57] ABSTRACT

Picture display device comprising an in-line color display tube of the shadow mask type having an elongate display screen with a short axis and a long axis, and comprising a deflection system. The plane in which the undeflected electron beams are located is parallel to the short axis of the display screen. The shadow mask has elongate apertures with longitudinal axes extending transversely to the short axis of the display screen. This configuration renders the picture display device less sensitive to unwanted displacements of the shadow mask in the direction transverse to the display screen, which is advantageous, particularly for display screen aspect ratios of more than 4:3.

7 Claims, 2 Drawing Sheets

SHADOW MASK COLOR DISPLAY TUBE

BACKGROUND OF THE INVENTION

The invention relates to a picture display device comprising a colour display tube having an elongate display screen with a short axis and a long axis, which screen is provided on an inner surface, and a shadow mask arranged in front of the display screen and comprising an arrangement of elongate apertures, an electron gun system arranged opposite the display screen for producing co-planar electron beams and a deflection system arranged between the electron gun system and the display screen.

The display device described above is of a type which has hitherto been conventional. The plane in which the undeflected electron beams are located is parallel to the long axis of the display screen. The orthogonal deflection fields generated by the deflection system upon energisation generally have such a (pincushion-shaped and barrel-shaped) configuration, viewed in the planes transverse to the axis of the display tube, that the display device is self-convergent.

A problem in this type of display device in its current form is the sensitivity to landing errors due to thermally or mechanically induced errors in the distance between the mask and the screen. This problem is not new, but it will become even more manifest in future HDTV systems with aspect ratios of more than 4:3, particularly 16:9, because the horizonatl deflection angles and hence the landing angles of the electron beams increase in the horizontal plane, while the diagonal deflection angle remains the same.

SUMMARY OF THE INVENTION

It is an object of the invention to provide a solution to the problem described above.

To this end a picture display device according to the invention is characterized in that the plane in which the undeflected electron beams are located is parallel to the short axis of the display screen, in that the deflection system comprises a first system of deflection coils for generating, upon energisation, a substantially pincushion-shaped deflection field in the direction of the short axis of the display screen and a second system of deflection coils for generating, upon energisation, a substantially barrel-shaped deflection field in the direction of the long axis of the display screen, and in that the longitudinal axes of the apertures in the shadow mask extend transversely to the short axis of the display screen.

The above-mentioned solution involves a rotation of the plane of the gun, deflection system and apertures in the shadow mask through an angle of 90° with respect to the conventional orientation. (The properties of self-convergence, if any, are not changed).

The orientation of the phosphor pattern (red, green and blue phosphor triplets) is adapted thereto.

The rotation of the apertures in the shadow mask, made possible by the rotation of the electron gun system and the deflection system, ensures a reduction of the thermally induced mask sphericity at high beam currents and reduces the effect of mechanical mask displacements (which may result from shocks or impacts on the tube, or from traversing a temperature cycle during tube manufacture) on the electron beam landing on the phosphor pattern, notably landing errors which are induced by moving the shadow mask in a direction transverse to the display screen. A reduction of the landing errors induced by the above-described effects by 50% is found to be possible in tubes having a display screen aspect ratio of 4:3 and even by 75% in tubes having a display screen aspect ratio of 16:9.

The above-described advantage of the inventive orientation of the tube components can be utilised as such. However, in accordance with a first preferred embodiment it may be alternatively utilised for use of iron shadow masks in cases where nickel-iron ("invar-type") shadow masks would otherwise have to be used. In accordance with a second embodiment it may be utilized for use of increased beam currents.

BRIEF DESCRIPTION OF THE DRAWING

An embodiment of the invention will now be described in greater detail by way of example with reference to the accompanying drawing figures in which.

DESCRIPTION OF THE PREFERRED EMBODIMENT

Figure 1:
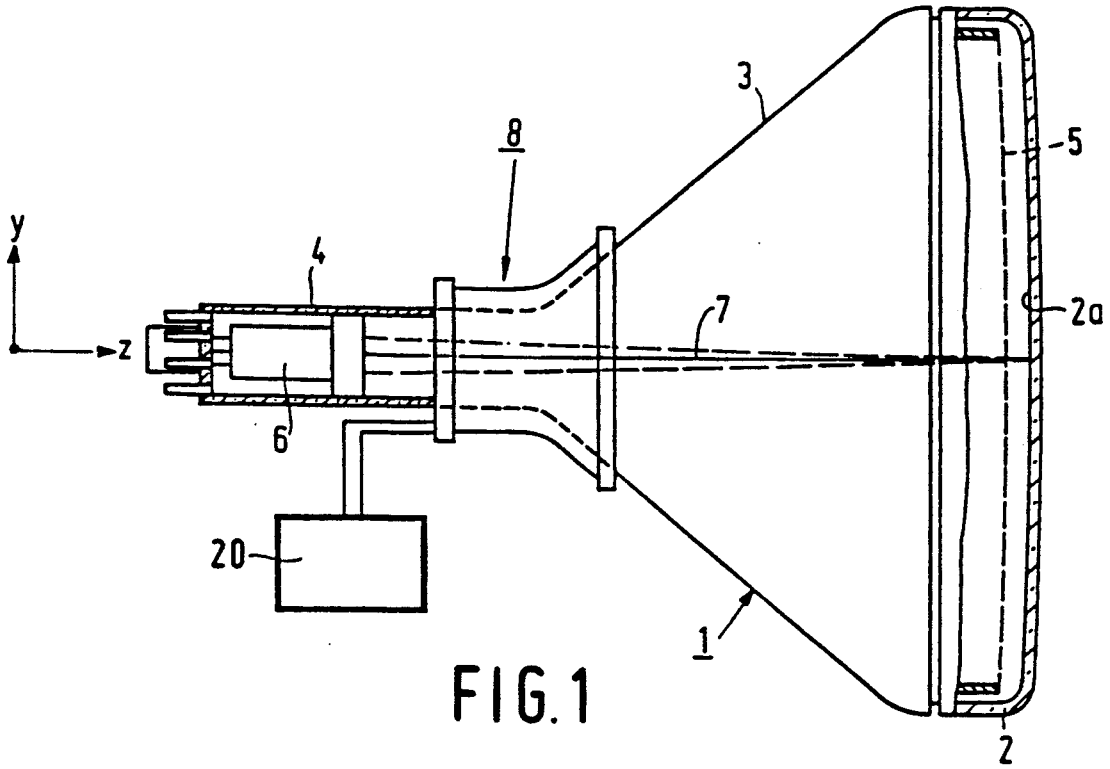
FIG. 1 is a longitudinal section through a colour display tube for a display device according to the invention.

As is shown in FIG. 1, a colour electron beam tube 1 generally has a panel portion 2, a funnel portion 3 and a neck portion 4.

The panel portion 2 is provided with a flourescent display screen **2*a* constituted by luminescent materials for the three primary colours red, green and blue, and a shadow mask 5** serving as a colour selection means. The display screen may have a conventional aspect ratio of 4:3. However, the advantages of the invention become more manifest as the aspect ratio is larger than 4:3. Display screens for HDTV display tubes may have an aspect ratio of, for example, 16:9.

The neck portion 4 comprises an electron gun 6 for emitting electron beams 7. The funnel portion 3 connects the panel portion 2 and the neck portion 4 in order to define a vacuum space, and a deflection system 8 comprising two sets of deflection coils **9*a*, 9*b* and 10*a*, 10*b* (see FIG. 2) is externally mounted in the area of transition between the funnel and neck portions. The deflection system 8 is connected to a signal generator 20 for scanning the display screen 2*a*** in accordance with rasters having lines which are parallel at one of the display screen sides.

The electron gun 6 arranged in the neck portion 4 is of the in-line type.

Figure 2:
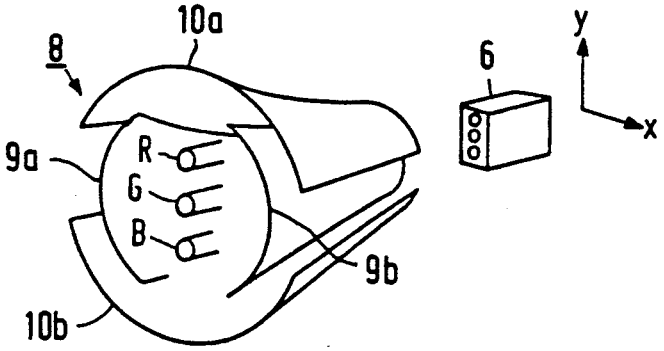
FIG. 2 is a diagrammatic front elevation of an arrangement of a gun system and a system of deflection coils for the display tube of FIG. 1.

FIG. 2 shows three co-planar electron beams R, G, B which can be generated by electron gun system 6. A pair **9*a*, 9*b* of deflection coils is used for deflecting the electron beams across a display screen in a direction parallel to the plane of the undeflected beams, and a pair 10*a*, 10*b* of deflection coils is used for deflection in a direction transverse to said plane. In the case shown both coil pairs are formed as saddle coils. However, they may be alternatively formed as toroidal coils, particularly the coil pair 10***a*, 10*b*. The arrangement according to FIG.2 may be used to scan a display screen in accordance with rasters having a plurality of lines parallel to the long axis of the display screen (FIG. 3).

Figure 4:
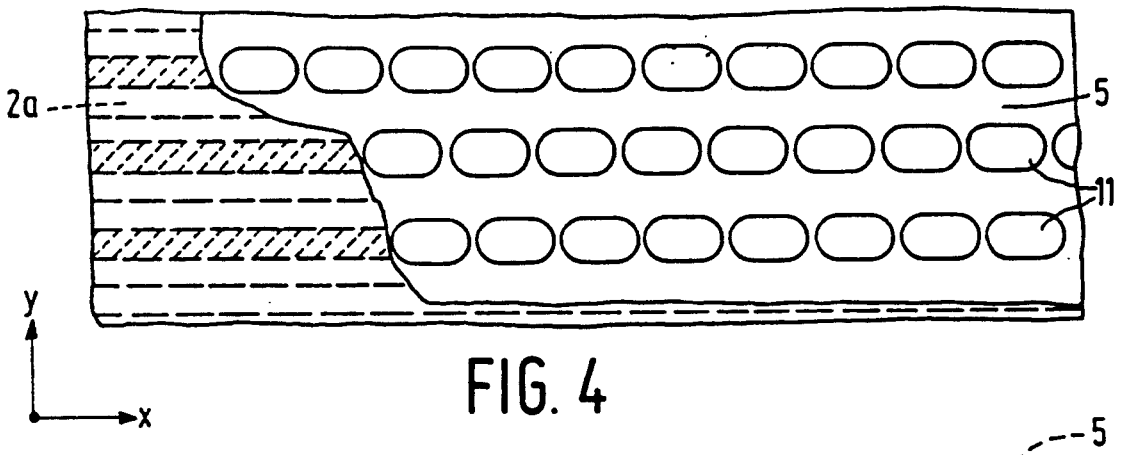
FIG. 4 is a plan view of a shadow mask to be used in a display tube for a display device according to the invention.
Figure 5:
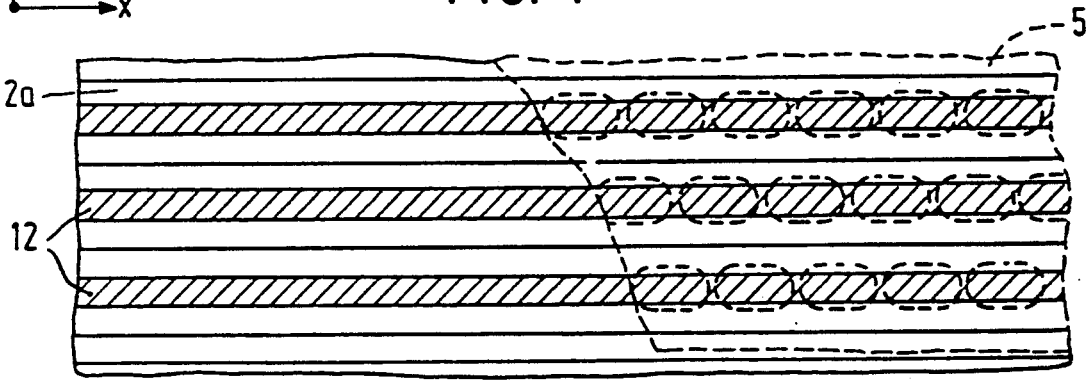
FIG. 5 is a plan view of a display screen to be used in combination with the shadow mask of FIG. 4.
Figure 6:
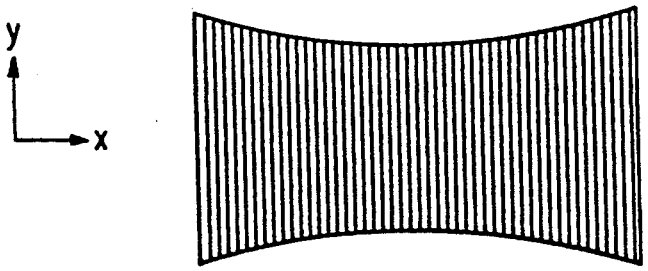
FIG. 6 shows the shape of a raster scanned by the gun-coil arrangement of FIG. 2 in accordance with vertical lines.

The shadow mask 5 used within the scope of the present invention is a "slit" mask having slit-shaped apertures 11 extending parallel to the long axis of the shadow mask (FIG. 4). This shadow mask cooperates in the display tube 1 with a display screen 2*a* having elongate phosphor areas 12 (FIG. 5) extending parallel to the long axis of the display screen. As stated hereinbefore, movements of the shadow mask in a direction transverse to the display screen thus have considerably less influence on the electron beam landing on the phosphor pattern on the display screen than in the case of the conventional shadow mask having apertures transverse to the long axis.

Figure 3:
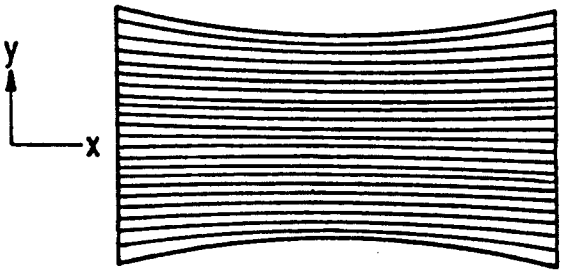
FIG. 3 shows the shape of a raster scanned by the gun-coil arrangement of FIG. 2.

During scanning a (pincushion-shaped) raster distortion is produced at the long sides of the raster when a "vertical" self-convergent combination of a tube and a coil is used (FIG. 3). When scanning rasters having a plurality of lines which are parallel to the long axis of the display screen, such a raster distortion is difficult to correct, both electronically and coil-techinically.

However, when scanning a raster having a plurality of lines which are parallel to the short axis of the display screen (FIG. 5), the raster distortion at the long sides of the raster can be easil corrected by means of an electronic correction circuit (which modulates the amplitude of the deflection voltages which are applied to the coil system 9*a*, 9*b* deflecting in the y-direction). In this case the scan at the high frequency thus takes place in the direction of the short axis of the display screen and the scan at the low frequency takes place in the direction of the long axis of the display screen. In order to realize self-convergence, the substantially barrel-shaped deflection field generated by coil system 10*a*, 10*b* for deflection in the x-direction may in known manner have a pincushion-shaped component, and the substantially pincushion-shaped deflection field generated by coil system 9*a*, 9*b* (which has the lowest impedance and is preferably arranged closest to the electron beams) for deflection in the y-direction may have a barrel-shaped component.

It is to be noted that in cases where images are scanned in a raster with horizontal lines at the pick-up side of the transmission system, a memory is required at the receiver end so as to be able to scan in a raster with vertical lines (so-called transposed scanning). In monitor tubes for data applications the scan conversion may take place, for example in the software used.

It is further to be noted that in conventional display tubes with a (line) shadow mask Moiré effect problems occur which get bigger as the spot gets smaller. (This is caused by the fact that modulation of the transmission takes place in the vertical direction due to the areas which are present between the slit-shaped apertures). In the conventional display tubes the spot upon deflection in the direction of the slits becomes increasingly narrower. When using a slit shadow mask rotated through 80°, in combination with "vertical" scanning, the spot upon deflection in the direction of the slits will be much less narrow and the problem of the Moiré effect will be accordingly smaller.

I claim:

1. A picture display device comprising a color display tube having an elongate display screen with a short axis and a long axis, which screen is provided on an inner surface, and a shadow mask arranged in front of the display screen and comprising an arrangement of elongate apertures, an electron gun system arranged opposite the display screen for producing co-planar electron beams and a deflection system arranged between the electron gun system and the display screen, characterized in that the plane in which the undeflected electron beams are located in parallel to the short axis of the display screen, in that the deflection system comprises a first system of deflection coils for generating, upon energization, a substantially pincushion-shaped deflection field for deflecting the electron beams in the direction of the short axis of the display screen and a second system of deflection coils for generating, upon energization, a substantially barrel-shaped deflection field for deflecting the electron beams in the direction of the long axis of the display screen, and in that the longitudinal axes of the apertures in the shadow mask extend transversely to the short axis of the display screen.

2. A display device as claimed in claim 1, characterized in that the display screen comprises elongate phosphor areas whose longitudinal axes extend transversely to the short axis of the display screen.

3. A display device as claimed in claim 1, characterized in that the combination of colour display tube and deflection system is self-convergent.

4. A display device as claimed in claim 1, characterized in that the display screen of the display tube has an aspect ratio of more than 4:3.

5. A display device as claimed in claim 1, characterized in that the shadow mask is made of a material mainly comprising iron.

6. A display device as claimed in claim 1, characterized in that the electron gun system has terminals to be connected to a device for realising increased beam currents.

7. A display device as claimed in claim 2, 3, 4, 5 or 6, characterized in that the deflection system has terminals to be connected to a signal generator for scanning the display screen in accordance with rasters having a plurality of lines which are parallel to the short axis of the display screen.

* * * * *